US011839580B2

(12) United States Patent
Ohta et al.

(10) Patent No.: US 11,839,580 B2
(45) Date of Patent: Dec. 12, 2023

(54) ASSIST DEVICE

(71) Applicant: JTEKT CORPORATION, Osaka (JP)

(72) Inventors: Hiromichi Ohta, Kariya (JP); Kazuyoshi Ohtsubo, Chiryu (JP); Tomoki Arai, Kitakatsuragi-gun (JP); Yoshitaka Yoshimi, Kashiba (JP)

(73) Assignee: JTEKT CORPORATION, Kariya (JP)

( * ) Notice: Subject to any disclaimer, the term of this patent is extended or adjusted under 35 U.S.C. 154(b) by 249 days.

(21) Appl. No.: 17/084,707

(22) Filed: Oct. 30, 2020

(65) Prior Publication Data

US 2021/0128389 A1 May 6, 2021

(30) Foreign Application Priority Data

Nov. 5, 2019 (JP) ..... 2019-200630

(51) Int. Cl.
*A61H 1/02* (2006.01)

(52) U.S. Cl.
CPC ... *A61H 1/0292* (2013.01); *A61H 2201/1215* (2013.01); *A61H 2201/149* (2013.01); *A61H 2201/163* (2013.01); *A61H 2201/1616* (2013.01); *A61H 2201/1621* (2013.01);
(Continued)

(58) Field of Classification Search
CPC ..... A61H 1/0292; A61H 2201/1295; A61H 2201/149; A61H 2201/1616; A61H 2201/1621; A61H 2201/163; A61H 2201/1642; A61H 2201/1652; A61H 2201/5064
See application file for complete search history.

(56) References Cited

U.S. PATENT DOCUMENTS

2018/0064357 A1* 3/2018 Motoyama ..... A61H 1/02
2018/0153722 A1* 6/2018 Cromie ..... A61B 5/6812
2018/0272525 A1 9/2018 Kumeno et al.
(Continued)

FOREIGN PATENT DOCUMENTS

JP 2010-94147 A 4/2010
JP 2013-176429 A 9/2013
(Continued)

OTHER PUBLICATIONS

Notification of Reasons for Refusal dated Aug. 29, 2023, issued in corresponding Japanese patent application No. 2019-200630 (wtih partial translation).

*Primary Examiner* — Jerrah Edwards
*Assistant Examiner* — Aren Patel
(74) *Attorney, Agent, or Firm* — Oblon, McClelland, Maier & Neustadt, L.L.P.

(57) ABSTRACT

An assist device includes a first worn component worn on at least one of a shoulder and a chest of a user, a second worn component worn on one of a hip and a pair of right and left legs of the user, a belt member provided along a back side of the user over the first worn component and the second worn component, an actuator provided on one of the first worn component and the second worn component, a position detection unit configured to obtain a position parameter indicating a position of the user, and a controller configured to obtain a required output in a direction to wind up the belt member from the actuator based on the position parameter and configured to control operation of the actuator.

8 Claims, 13 Drawing Sheets

(52) U.S. Cl.
CPC ..... *A61H 2201/1642* (2013.01); *A61H 2201/1652* (2013.01); *A61H 2201/5064* (2013.01)

(56) References Cited

U.S. PATENT DOCUMENTS

| | | | | |
|---|---|---|---|---|
| 2019/0029912 | A1* | 1/2019 | Murakami | A61H 1/0262 |
| 2019/0282900 | A1* | 9/2019 | Goetgeluk | A63F 13/216 |
| 2020/0038218 | A1* | 2/2020 | Ingvast | A61B 5/1071 |
| 2020/0179218 | A1* | 6/2020 | Katoh | A61H 3/00 |
| 2020/0289357 | A1 | 9/2020 | Sato et al. | |

FOREIGN PATENT DOCUMENTS

| | | | |
|---|---|---|---|
| JP | 2018-149613 | A | 9/2018 |
| JP | 2018-199205 | A | 12/2018 |
| JP | 2019-155506 | A | 9/2019 |
| JP | 2020-146760 | A | 9/2020 |
| WO | 2011/111765 | A1 | 9/2011 |

* cited by examiner (FORWARD-LEANING POSITION)

(UPRIGHT POSITION)

FIG. 9 i2

| POSITION ANGLE θL | REQUIRED OUTPUT |
|---|---|
| θ L−1 | Pa |
| θ L−2 | Pb |
| ⋮ | ⋮ |
| θ L−30 | Pc |
| ⋮ | ⋮ |
| θ L−90 | Pd |
| ⋮ | ⋮ |

FIG. 10 i3

| | ANGULAR VELOCITY | COEFFICIENT F |
|---|---|---|
| LOW | ω10 | 1.3 |
| | ⋮ | ⋮ |
| | ω20 | 1.0 |
| | ⋮ | ⋮ |
| | ω30 | 0.7 |
| | ⋮ | ⋮ |
| | ω40 | 0.5 |
| HIGH | ⋮ | ⋮ |

ASSIST DEVICE

CROSS-REFERENCE TO RELATED APPLICATION

This application claims priority to Japanese Patent Application No. 2019-200630 filed on Nov. 5, 2019, incorporated herein by reference in its entirety.

BACKGROUND

1. Technical Field

The disclosure of the disclosure relates to an assist device.

2. Description of Related Art

Various assist devices worn on the bodies of users (people) to help the users to perform work have been suggested. With assist devices, users are able to perform work with less force (less load) even in the case of lifting up, for example, a heavy object. Such an assist device is described in, for example, Japanese Unexamined Patent Application Publication No. 2018-199205 (JP 2018-199205 A).

SUMMARY

The assist device described in JP 2018-199205 A includes a frame made of a metal or the like and worn on a user. The output of an actuator mounted on the frame is transferred to the upper body and lower body of the user through a link mechanism. With this configuration, the user is helped to, for example, lift up a heavy object.

Motions for which users need help include not only a high-load motion, such as lifting up a heavy object, but also, for example, motions to help people, such as patients and elderly people, in daily life activities. When a user performs high-load work, a high-power assist device as described in JP 2018-199205 A is effective.

However, when a user helps people, such as patients and elderly people, a high-power assist device may have excessive performance. In a high-power assist device, many rigid members such as a link mechanism and a frame made of a metal or the like are used, so a heavy configuration is provided to obtain high power. Therefore, the weight of the assist device is heavy, so the motion of the user is limited by the rigid members.

The inventors of the disclosure have already suggested a light-weight, good wearing assist device (for example, Japanese Patent Application No. 2019-043462). The assist device includes a first worn component worn on the shoulders of a user, a second worn component worn on the right and left legs of the user, a belt member provided along a back side of the user over the first worn component and the second worn component, and an actuator. The actuator is provided on the first worn component and is capable of winding up or letting out part of the belt member.

When the actuator winds up part of the belt member, tension is applied to the belt member. This tension becomes assisting force and acts on the user. With this configuration, when, for example, the user helps people as described above, load on the user is reduced.

In the assist device including the above-described belt member, assisting force that is applied to a user is not always constant, and, for example, assisting force with a strength for the position of a user is desirably applied. The disclosure applies assisting force with an appropriate strength to a user according to the position of the user.

An aspect of the disclosure relates to an assist device. The assist device includes a first worn component, a second worn component, a belt member, an actuator, a position detection unit, and a controller. The first worn component is worn on at least one of a shoulder and a chest of a user. The second worn component is worn on one of a hip and a pair of right and left legs of the user. The belt member is provided along a back side of the user over the first worn component and the second worn component. The actuator is provided on one of the first worn component and the second worn component. The actuator is configured to wind up part of the belt member and configured to let out part of the belt member. The actuator is configured to apply assisting force to the user by applying a force to the belt member in a direction to wind up the belt member. The position detection unit is configured to obtain a position parameter indicating a position of the user. The controller is configured to obtain a required output in the direction to wind up the belt member from the actuator based on the position parameter and configured to control operation of the actuator.

With the above configuration, the actuator does not operate at a constant output regardless of the position of a user, and the actuator operates at an output for the position of the user (position parameter). Therefore, the assist device is capable of applying assisting force with an appropriate strength to a user according to the position of the user.

In the assist device, the controller may be configured to cause the actuator to operate at a predetermined output in a standby state where the assisting force is not applied to the user. The predetermined output may be an output in the direction to wind up the belt member and weaker than an output when the assisting force is applied to the user. With the above configuration, although the first worn component and the second worn component are worn on the user, the belt member does not loosen in a standby state where assisting force is not applied. Therefore, when the actuator winds up the belt member at the time when the user changes the position, it is possible to quickly apply assisting force to the user.

When, for example, the user changes from an upright position to a forward-leaning position with a quick motion, it is desirable to reduce the output of the actuator in the direction to wind up the belt member so as not to interfere with the position change. In contrast, when, for example, the user changes from an upright position to a forward-leaning position with a slow motion as in the case where a load is lifted down, it is desirable to increase the output of the actuator.

In the assist device, the position detection unit may be configured to obtain a rate of change in position when the user shifts from an upright position to a forward-leaning position. The controller may be configured to obtain the required output according to the rate of change. With the above configuration, for example, the required output of the actuator is able to be varied between a case where the user changes from an upright position to a forward-leaning position with a quick motion and a case where the user changes the position with a slow motion. Even in the same intermediate position between an upright position and a forward-leaning position, the required output of the actuator is obtained according to a speed of motion, that is, a rate of change in position.

When the output of the actuator in the direction to wind up the belt member is too low as a result of obtaining the required output according to the rate of change, the belt member may loosen and then, when assisting force is needed, it may be not possible to appropriately generate assisting force. In the assist device, the controller may be configured to, when the required output obtained according to the rate of change is lower than a lower limit set value, obtain the lower limit set value or a value exceeding the lower limit set value as the required output of the actuator. With the above configuration, it is possible to prevent slack in the belt member.

When, for example, the user changes from a forward-leaning position to an upright position with a slow motion as in the case of lifting up a load, it is desirable to increase the output of the actuator as compared to when the user changes the position with a quick motion.

In the assist device, the position detection unit may be configured to obtain a rate of change in position when the user changes from a forward-leaning position to an upright position. The controller may be configured to obtain the required output according to the rate of change. With the above configuration, for example, the required output of the actuator is able to be varied between a case where the user changes from a forward-leaning position to an upright position with a quick motion and a case where the user changes the position with a slow motion. In this way, even in the same intermediate position between an upright position and a forward-leaning position, the required output of the actuator is obtained according to a speed of motion, that is, a rate of change in position.

When the output of the actuator in the direction to wind up the belt member is too high as a result of obtaining the required output according to the rate of change, excessive load acts on the actuator, so it is not desirable for the actuator. In the assist device, the controller may be configured to, when the required output obtained according to the rate of change is higher than an upper limit set value, obtain the upper limit set value or a value lower than the upper limit set value as the required output of the actuator. With this configuration, it is possible to prevent application of excessive load to the actuator.

In the assist device, the position detection unit may include a detector configured to detect an operation amount of the actuator when the belt member is wound up or let out as a result of a change in position of the user, and a position estimation unit configured to obtain the position parameter based on correspondence information representing a relation between the operation amount and the position parameter. The operation amount of the actuator at the time of winding up or letting out the belt member due to a change in the position of the user correlates with the position of the user (position parameter). Therefore, with the above configuration, it is possible to obtain a position parameter of the user.

In the assist device, the position detection unit may include a sensor provided on one of the first worn component and the second worn component and configured to output a signal corresponding to a position of the user, and a position estimation unit configured to obtain the position parameter based on an output of the sensor. With the above configuration, a signal output from the sensor varies with a change in the position of the user, so it is possible to obtain a position parameter of the user.

With the assist device of the disclosure, it is possible to apply assisting force with an appropriate strength to a user according to the position of the user.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein:

FIG. 9 is a table showing conversion information;

FIG. 10 is a table showing coefficient information;

DETAILED DESCRIPTION OF EMBODIMENTS

Overall Configuration of Assist Device

Figure 1:
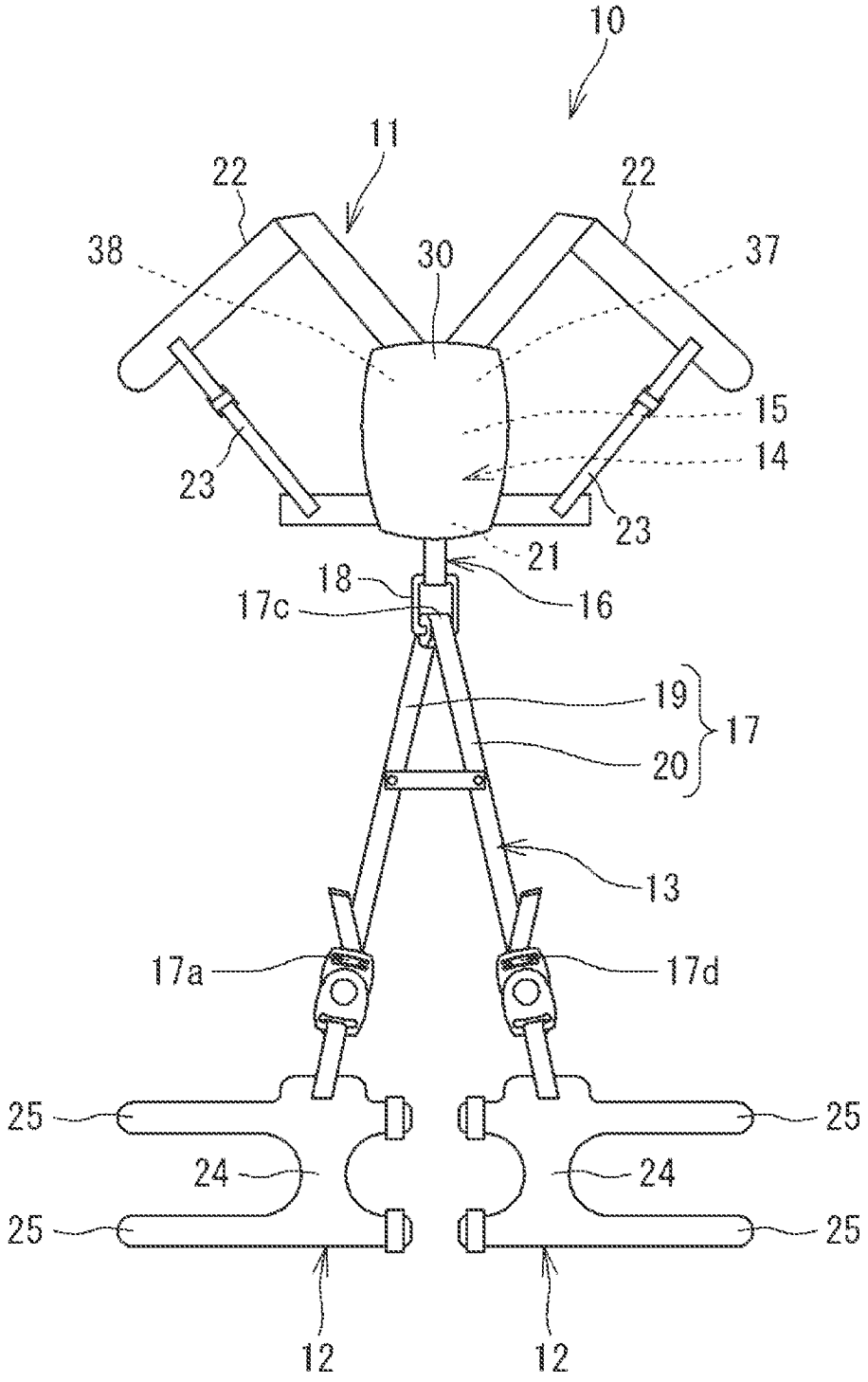
FIG. 1 is a back view showing an example of an assist device.
Figure 2:
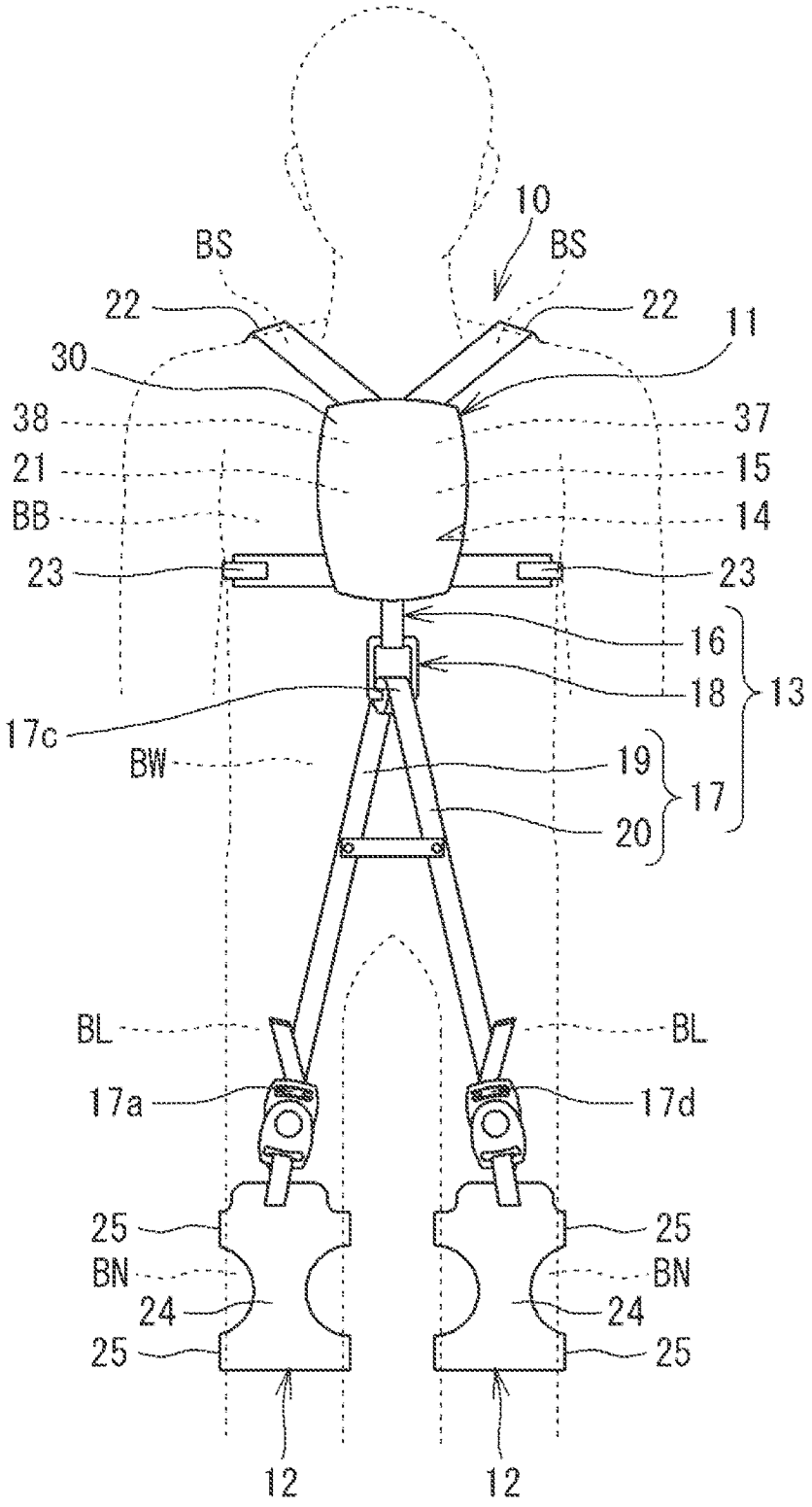
FIG. 2 is a back view of the assist device worn on a body of a user.
Figure 3:
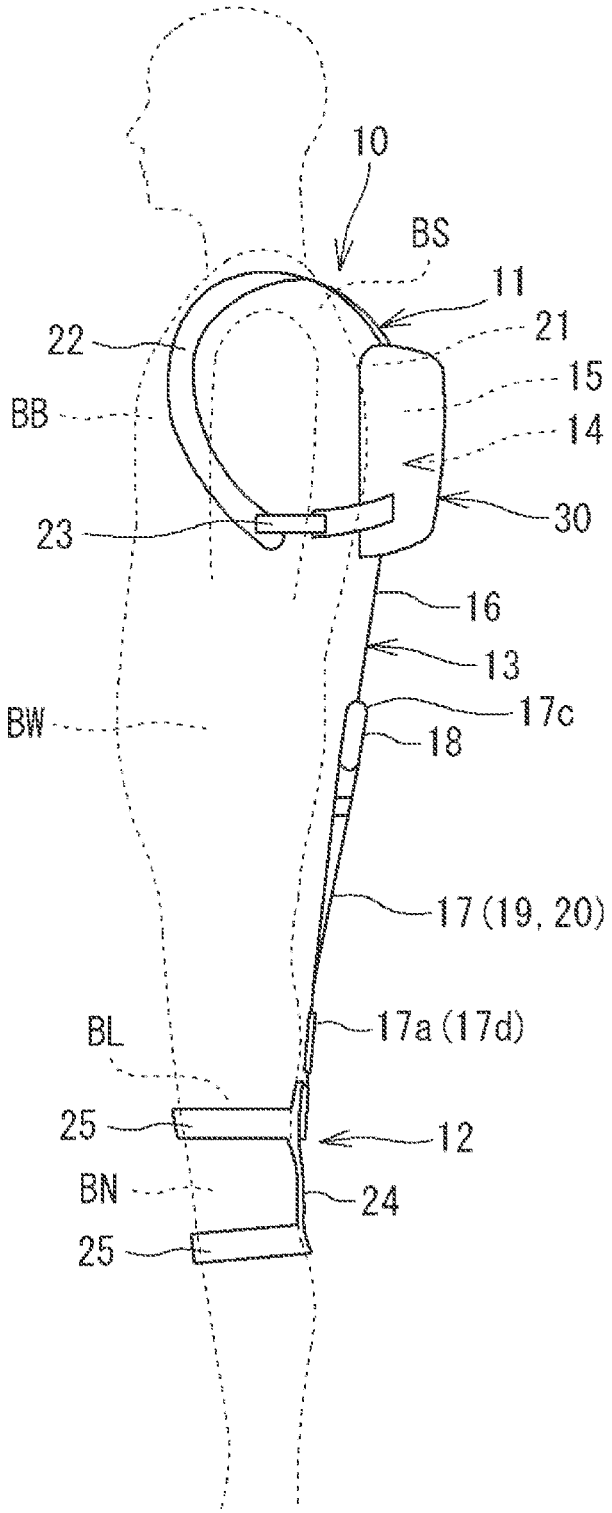
FIG. 3 is a side view of the assist device worn on the body of the user.
Figure 4:
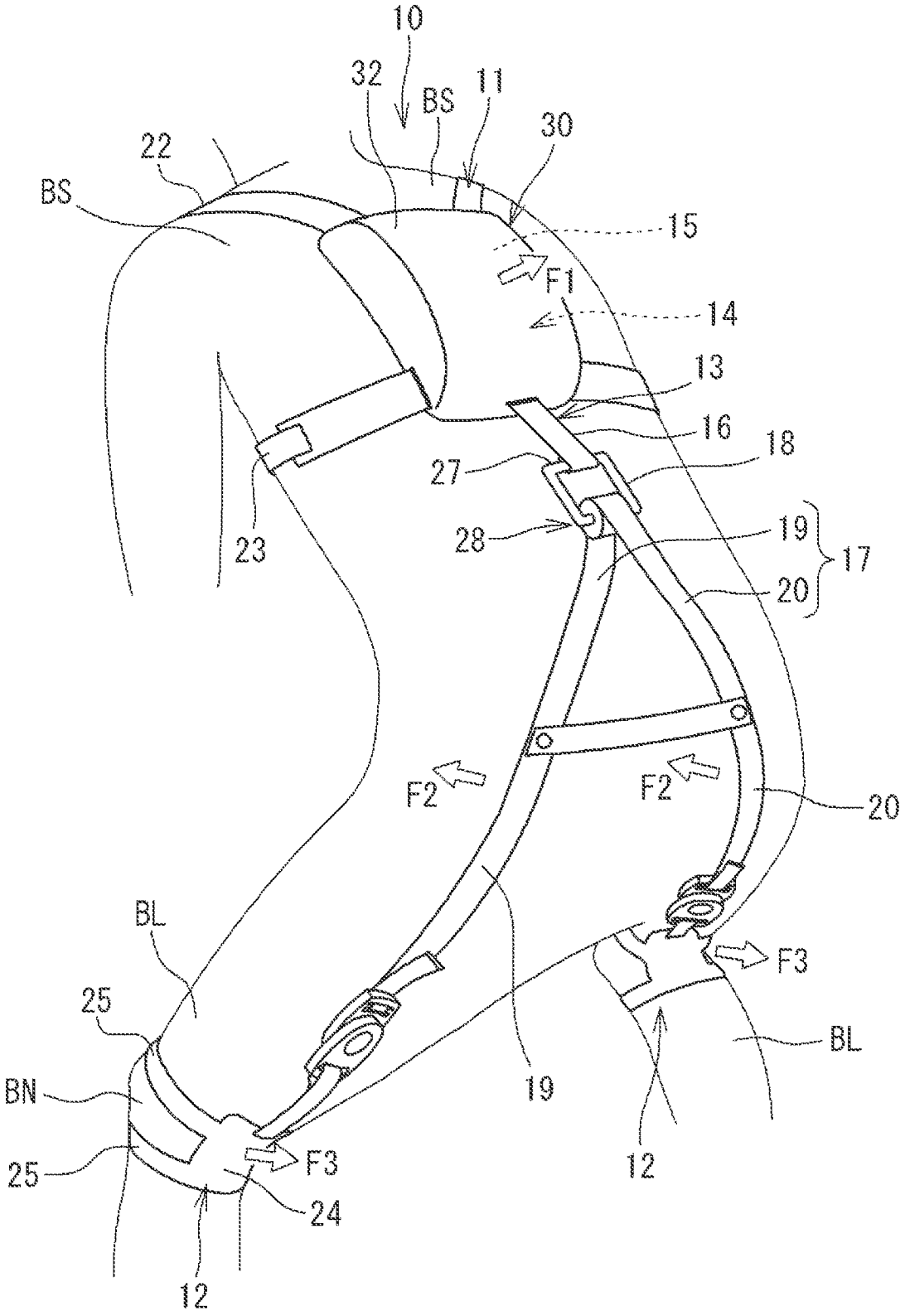
FIG. 4 is a view illustrating a state where the user wearing the assist device is in a forward-leaning position.

FIG. 1 is a back view showing an example of an assist device. FIG. 2 is a back view of the assist device worn on a body of a user. FIG. 3 is a side view of the assist device worn on the body of the user. FIG. 4 is a view illustrating a state where the user wearing the assist device is in a forward-leaning position (bent-over position).

The assist device 10 shown in FIG. 1 includes a first worn component 11 and two second worn components 12. The first worn component 11 is worn on right and left shoulders BS that are part of the body of the user (person). The two second worn components 12 are respective worn on right and left legs BL that are another part of the body of the user. The first worn component 11 just needs to be worn on at least one of a chest BB and the pair of shoulders BS of the user and may be other than the illustrated mode. In the disclosure, the second worn components 12 each are worn on a knee BN of the leg BL. The second worn components 12 may also be other than the illustrated mode.

In the assist device 10 of the disclosure, right and left sides are right and left sides of the user wearing the assist device 10 in an upright position, front and rear sides are front and rear sides of the user, and upper and lower sides are upper and lower sides of the user. The upper side is a user's head side. The lower side is a user's foot side.

The assist device 10 includes a belt member 13, an actuator 14, a controller 15, a battery 37, and a sensor 38 in addition to the first worn component 11 and the right and left second worn components 12.

The first worn component 11 is worn on the shoulders BS of the user. One of the second worn components 12 is worn on the left knee BN of the user. The other one of the second worn components 12 is worn on the right knee BN of the user. The right-side second worn component 12 and the left-side second worn component 12 are bilaterally symmetric and have the same configuration. The first worn component 11 and the two second worn components 12 are respectively worn on two portions, that is, the shoulders BS and the legs BL, spaced apart from each other across the lumbar vertebrae (hip BW) that are joints of the user.

The first worn component 11 is made of cloth or the like having flexibility. The first worn component 11 includes a back main body part 21 to be worn on the back of the user, and shoulder belts 22 and armpit belts 23 connected to the back main body part 21. With the shoulder belts 22 and the armpit belts 23, the back main body part 21 is carried on the back of the user. Each armpit belt 23 connects the back main body part 21 and the shoulder belt 22. The length of the armpit belt 23 is adjustable. Through adjustment of the length of each armpit belt 23, the back main body part 21 is brought into close contact with the back of the user. The first worn component 11 is worn so as not to be movable in the front-rear direction, the right-left direction, and the up-down direction relative to the shoulders BS.

The second worn components 12 are made of cloth or the like having flexibility. Each second worn component 12 includes a knee main body part 24 and knee belts 25. The knee main body part 24 is worn on the rear surface side of the knee BN of the user. The knee belts 25 are provided so as to extend from the knee main body part 24. The knee belts 25 respectively round the knee BN at the upper and lower sides of the knee BN, and the distal end sides are fixed to the knee main body part 24. Each knee belt 25 allows adjustment of the length of winding around the knee BN with a belt and a buckle or an anchor member, such as a hook-and-loop fastener. Through this adjustment, the knee main body part 24 is brought into close contact with the rear surface side of the knee BN. Each second worn component 12 is worn so as not to be movable in the front-rear direction, the right-left direction, and the up-down direction relative to the knee BN.

The belt member 13 is provided along the back surface side of the user so as to couple the first worn component 11 to the second worn components 12. The belt member 13 includes a first belt 16, a second belt 17, and a coupling member 18. The first belt 16 is provided on the upper body side. The second belt 17 is provided on the lower body. The coupling member 18 couples the first belt 16 and the second belt 17. Each of the first belt 16 and the second belt 17 is long and flexible. The coupling member 18 is made of a metal and is made up of a rectangular ring called "flat loop".

Each of the first belt 16 and the second belt 17 is a band-shaped member made of cloth or leather and can be bent along the shape of the body. Each of the first belt 16 and the second belt 17 may be a cordite belt (a wire-like member). Each of the first belt 16 and the second belt 17 of the disclosure is a non-stretchable member, that is, each of the first belt 16 and the second belt 17 has a characteristic difficult to stretch or does not stretch in its longitudinal direction.

Figure 5:
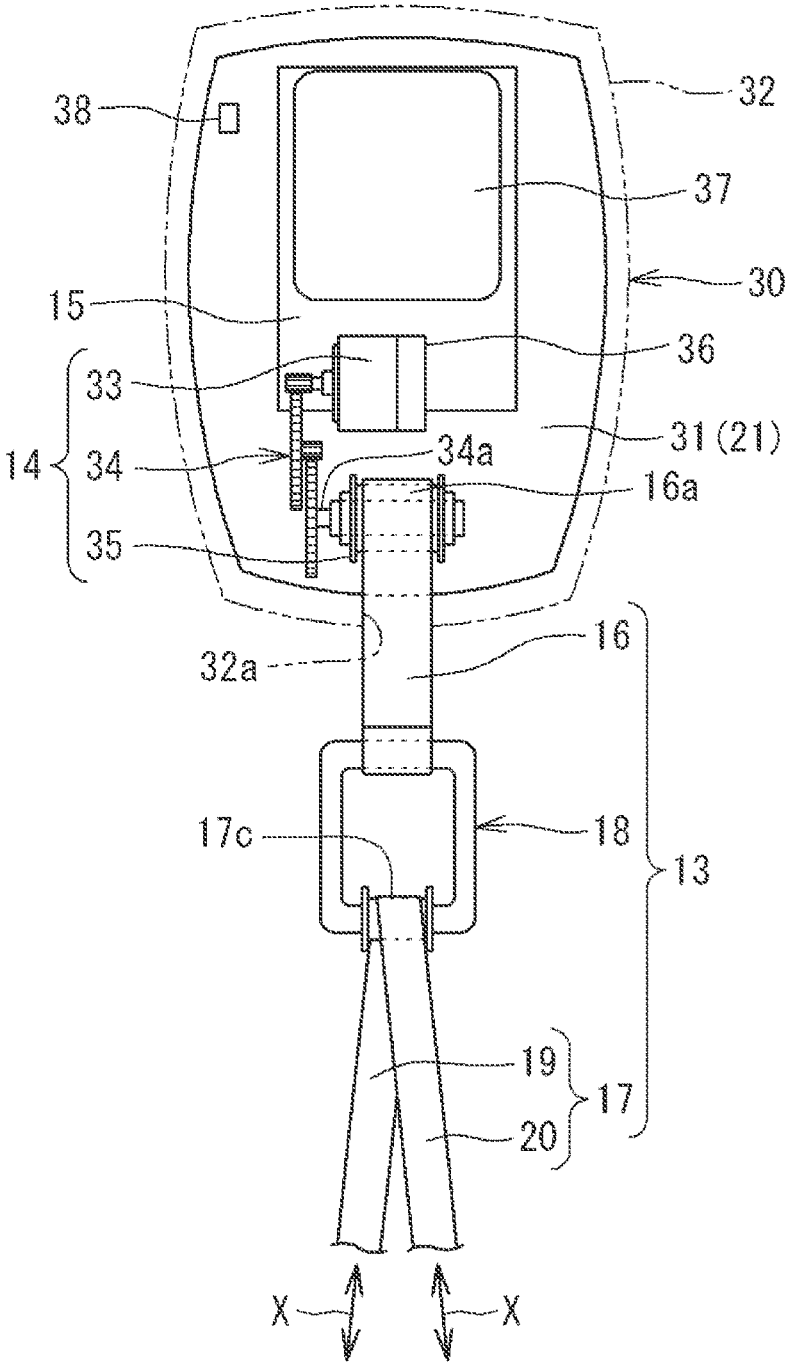
FIG. 5 is a view illustrating a control box and a belt member.

The assist device 10 of the disclosure includes a control box 30. The control box 30 is provided in the back main body part 21 of the first worn component 11. FIG. 5 is a view illustrating the control box 30 and the belt member 13. The control box 30 includes a sheet-shaped base 31, and a cover 32 covering the base 31. To illustrate the internal structure of the control box 30, the cover 32 is represented by an imaginary line (alternate long and two-short dashed line) in FIG. 5. The base 31 is provided in the back main body part 21 of the first worn component 11.

The actuator 14, the controller 15, the battery 37, the sensor 38, and the like are provided in the space defined between the base 31 and the cover 32. The cover 32 has an opening (cutout) 32*a*. The first belt 16 passes through the opening 32*a*.

The actuator 14 is provided inside the control box 30. In other words, the actuator 14 is provided on the first worn component 11. The actuator 14 is capable of winding up and letting out part of the belt member 13. Therefore, the actuator 14 includes a motor 33, a speed reduction unit 34, and a drive pulley 35. The motor 33 is a brushless DC motor. The motor 33 is capable of rotating at a predetermined rotation speed at a predetermined torque based on a drive signal output from the controller 15.

A parameter related to rotation, such as the rotation angle, the rotation speed, and the number of revolutions, of the motor 33 is detected by a rotation detector 36 installed in the motor 33. The rotation detector 36 of the disclosure is a rotary encoder. Alternatively, the rotation detector 36 may be a Hall sensor or a resolver. A detection result of the rotation detector 36 is input to the controller 15. When the controller 15 controls the operation of the motor 33 based on the detection result, the assist device 10 is able to generate appropriate assisting force.

The speed reduction unit 34 is made up of a plurality of gears. The speed reduction unit 34 reduces the number of revolutions of the motor 33 and rotates an output shaft 34*a* of the speed reduction unit 34. The drive pulley 35 is coupled to the output shaft 34*a*, and the drive pulley 35 and the output shaft 34*a* rotate integrally with each other. One end 16*a* of the first belt 16 is connected to the drive pulley 35. When the drive pulley 35 rotates in one direction as a result of forward rotation of the motor 33, the first belt 16 is wound up by the drive pulley 35. When the drive pulley 35 rotates in the other direction, the first belt 16 is let out from the drive pulley 35.

In this way, the actuator 14 includes the drive pulley 35 and the motor 33. The drive pulley 35 is capable of winding up the belt member 13. The motor 33 is used to cause the drive pulley 35 to wind up the belt member 13. The first belt 16 is wound up and let out by the actuator 14. The actuator 14 is capable of applying assisting force to the user by applying a force to the belt member 13 (first belt 16) in a direction to wind up the belt member 13.

The controller 15 is made up of a control unit including a microcomputer. Although described later, the controller 15 controls the operation of the actuator 14 (motor 33). An acceleration sensor is provided as the sensor 38. A signal of the sensor 38 is input to the controller 15. Although described later, the controller 15 is capable of estimating the position of the user based on a signal from the sensor 38. The battery 37 supplies electric power to the controller 15, the motor 33, the rotation detector 36, and the sensor 38. The sensor 38 may be provided outside the control box 30. The sensor 38 may be an inclination sensor, a gyro sensor, a magnetic field sensor, or the like, other than the acceleration sensor. Alternatively, the sensor 38 may be made up of a combination of some of these sensors.

Belt Member 13

The belt member 13, as described above, includes the first belt 16, the second belt 17, and the coupling member 18. One end 16*a* of the first belt 16 is wound on the drive pulley 35 and fixed. The other end 16*b* of the first belt 16 is fixed to the coupling member 18. When the motor 33 rotates in a forward direction and the first belt 16 is wound up by the drive pulley 35, the coupling member 18 is raised. When the coupling member 18 is forcibly lowered, the first belt 16 is let out (pulled out) from the drive pulley 35. At this time, the motor 33 rotates in a reverse direction. There is a correlation between the wind-up amount or let-out amount (pull-out amount) of the first belt 16 on the drive pulley 35 and the rotation amount of the output shaft of the motor 33. A parameter related to rotation of the motor 33 resulting from winding up or letting out the belt member 13 is detected by the rotation detector 36.

The second belt 17 is hung on part of the coupling member 18 on the way in a folded back state. With this configuration, the second belt 17 is not fixed to the coupling member 18 and is placed in a folded back state. The second belt 17 is supported by the coupling member 18 so as to be movable in both directions (arrow X direction in FIG. 5) of the longitudinal direction.

As shown in FIG. 2, the second belt 17 is connected to the second worn components 12. More specifically, the second belt 17 is made up of a single band-shaped member. One end 17*a* of the second belt 17 is connected to the left-side second worn component 12. The other end 17*d* of the second belt 17 is connected to the right-side second worn component 12. As described above, an intermediate part 17*c* of the second belt 17 is hung on the coupling member 18.

With the configuration of the second belt 17 as described above, the second belt 17 has a left-side second belt part 19 extending from the coupling member 18 to the left-side second worn component 12 and a right-side second belt part 20 extending from the coupling member 18 to the right-side second worn component 12. The second belt 17 is hung on the coupling member 18 and is not fixed, so the length of the left-side second belt part 19 and the length of the right-side second belt part 20 are freely changeable. However, the sum of the length of the left-side second belt part 19 and the length of the right-side second belt part 20 is constant. With this configuration, for example, walking of the user is not limited by the second belt 17, and the user is able to walk easily.

Assisting Force by Assist Device

Figure 7:
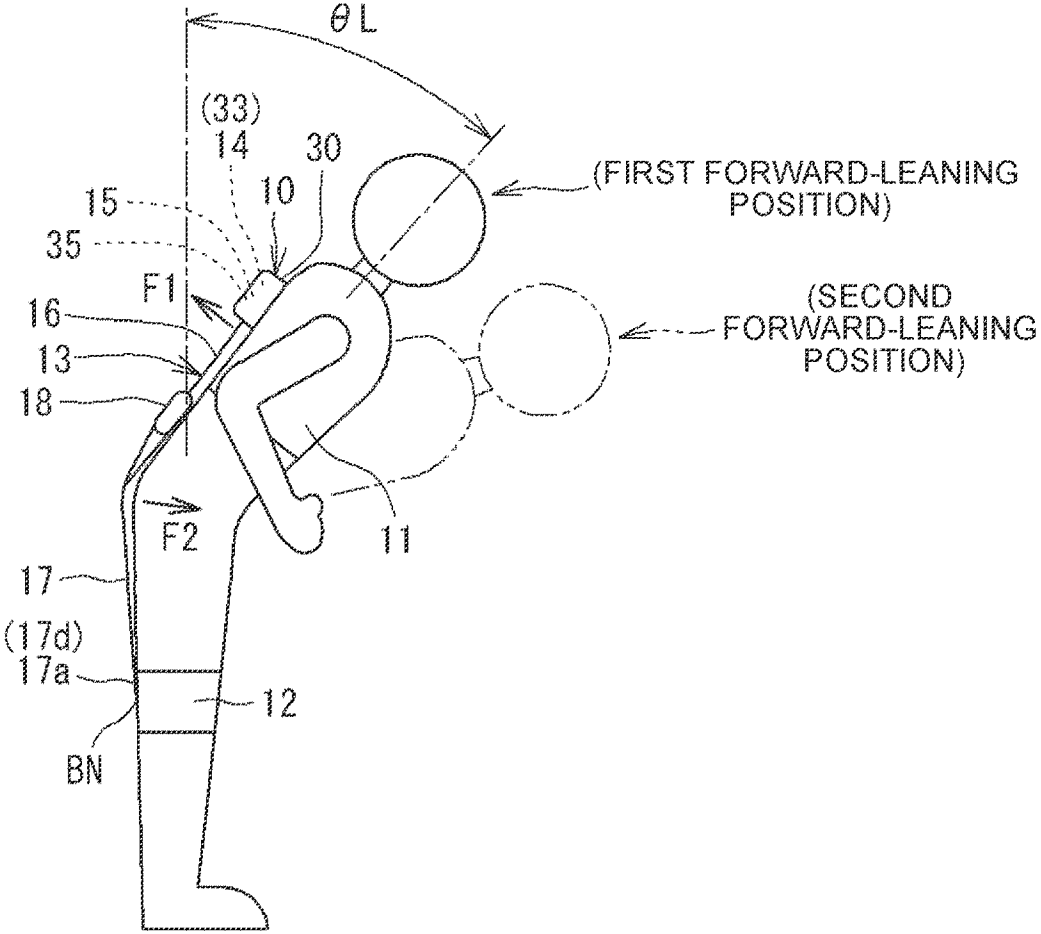
FIG. 7 is a view illustrating a case where the user wearing the assist device changes the position.
Figure 7:
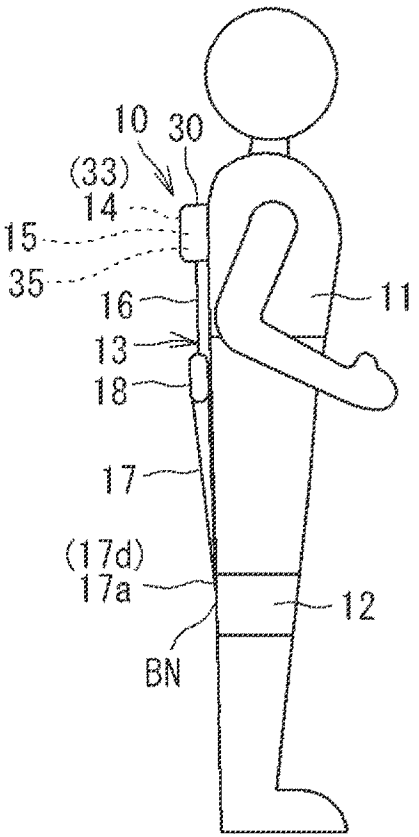

FIG. 7 is a view illustrating a case where the user wearing the assist device 10 changes the position. For this change in position, the assist device 10 is capable of applying assisting force to the user.

In a state where the assist device 10 is worn on the user, the motor 33 is constantly being operated in a direction to wind up the belt member 13 at a weak output (generating torque) to generate weak tension in the belt member 13 under control of the controller 15. In other words, in a standby state where assisting force is not applied to the user, the actuator 14 continues operating at a weak output in the direction to wind up the belt member 13. The weak output is an output weaker than that when assisting force is applied to the user. Based on the weak output of the actuator 14, weak tension is applied to the belt member 13. With this configuration, in a standby state where the assist device 10 is worn on the user and does not apply assisting force, the belt member 13 does not loosen. When, particularly, the user does not lift down a person, an object, or the like and simply changes from an upright position to a forward-leaning position with no need of assisting force, the user is able to change into a forward-leaning position against the weak tension of the belt member 13. At this time, in accordance with the amount of change in position, the belt member 13 is let out from the drive pulley 35 by a predetermined amount.

When the user changes from a forward-leaning position to an upright position to, for example, lift up a person or an object, the actuator 14 operates in the direction to wind up the belt member 13 at a required output to generate assisting force. In other words, the first belt 16 is wound up to the drive pulley 35 by the motor 33. When the first belt 16 is wound up to the drive pulley 35, the coupling member 18 pulls up the second belt 17 toward the actuator 14, that is, upward. Both ends 17*d*, 17*a* of the second belt 17 are respectively connected to the right and left-side second worn components 12. Each second worn component 12 is fixed to the knee BN. Therefore, when the first belt 16 is wound up to the drive pulley 35, tension is applied to the first belt 16 and the second belt 17. The tension acts as assisting force on the user.

With the tension applied to the first belt 16 and the second belt 17, rearward acting force F1 is generated in the first worn component 11. In other words, acting force F1 is generated in a direction to get up the upper body of the user in a forward-leaning position. At the same time, the second belt 17 generates acting force F2 pushing the right buttock and left buttock of the user forward with its tension. With this configuration, the user is able to easily return from a forward-leaning position to an upright position.

On the other hand, when the user changes from an upright position to a forward-leaning position to lift down a load, the first belt 16 of the belt member 13 is let out from the drive pulley 35; however, to generate assisting force, the actuator 14 lets out the belt member 13 while applying braking force to letting out of the belt member 13. In other words, the first belt 16 is let out from the drive pulley 35; however, the actuator 14 generates torque in the direction to wind up the belt member 13 at a required output.

In this way, when assisting force is needed to, for example, lift up or lift down a person or a load, the actuator 14 operates at a predetermined output in the direction to wind up the belt member 13 even when the user changes from a forward-leaning position to an upright position or changes from an upright position to a forward-leaning position. A method of obtaining the required output of the actuator 14 in the direction to wind up the belt member 13 will be described later.

Controller

Figure 6:
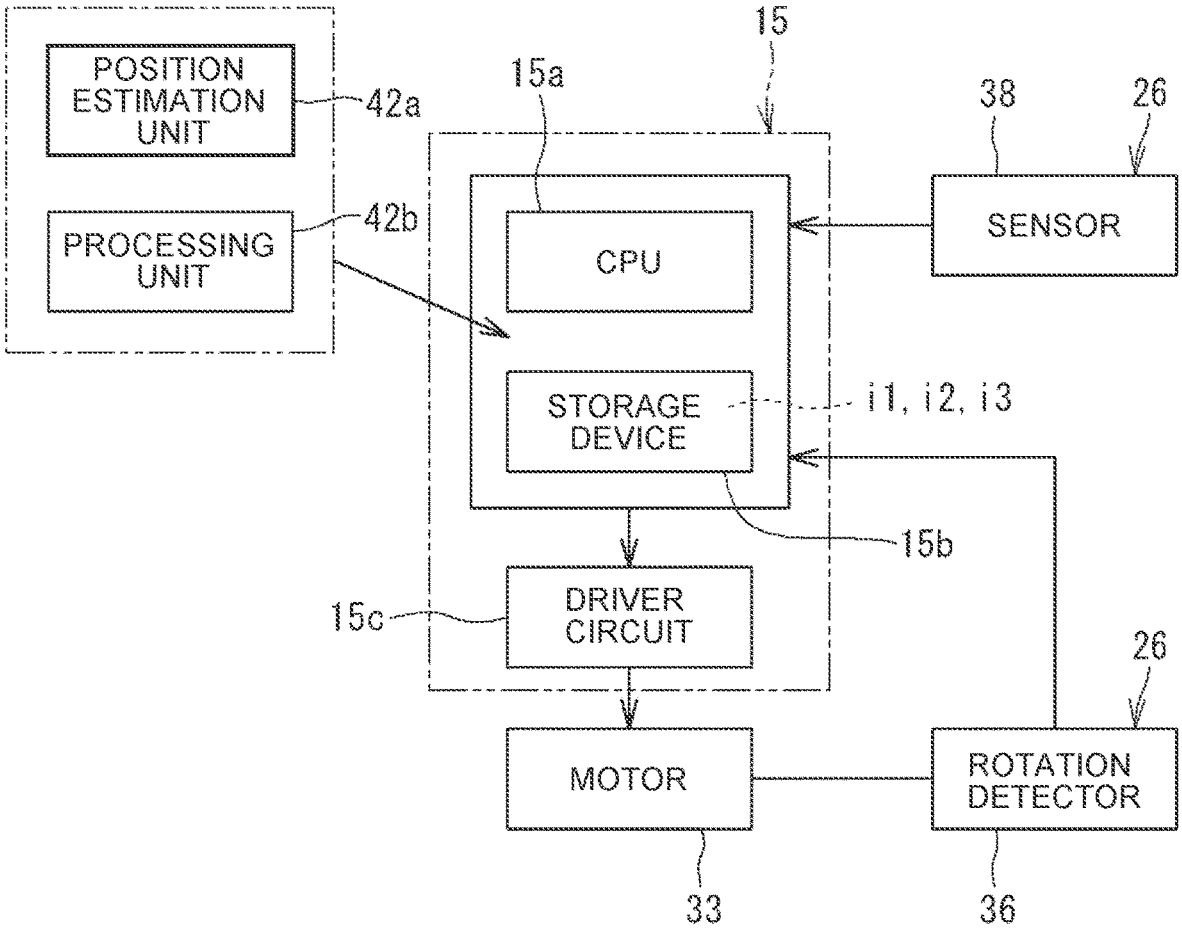
FIG. 6 is a block diagram showing a control configuration of the assist device.

FIG. 6 is a block diagram showing a control configuration of the assist device 10. The controller 15 is made up of a control unit including a microcomputer and includes an arithmetic processing unit (CPU) 15*a* and a storage device (storage unit) 15*b*, such as memory. The arithmetic processing unit 15*a* executes various arithmetic processing based on various programs, various parameters, and the like stored in the storage device 15*b*. The controller 15 of the disclosure includes a position estimation unit 42*a* and a processing unit 42*b* as functional units implemented through arithmetic processing by the arithmetic processing unit 15*a*. The controller 15 further includes a driver circuit (motor driver) 15*c* that controls the operation of the motor 33. Through cooperation between the above-described functional units and the driver circuit 15*c*, the motor 33 performs a predetermined operation.

Position Detection Unit

The assist device 10 includes a position detection unit 26 that obtains a position parameter indicating a position of the user. As shown in FIG. 7, the position parameter is an inclination angle θL of the upper body of the user with respect to a vertical line. The inclination angle θL is referred to as position angle θL. Hereinafter, description will be made on the assumption that the position parameter is the position angle θL of the user. When the user is in an upright position, θL=0. The position detection unit 26 may obtain the position angle θL based on a detected value of the sensor 38 or may detect the position angle θL based on the operation amount of the actuator 14, that is, the wind-up amount or let-out amount of the belt member 13. Description will be made in each case.

Position Detection Unit (Part 1)

The sensor 38 of the disclosure is made up of an acceleration sensor. The sensor 38 outputs a signal indicating the position of the user. The position estimation unit 42*a* as the functional unit of the controller 15 obtains the position angle θL of the user based on the output of the sensor 38. The position estimation unit 42*a* is capable of obtaining an angular velocity in a direction in which the position angle θL changes as a rate of change in the position of the user by finding the time derivative of the obtained position angle θL. Since the position angle θL is obtained every second, an angular velocity may be obtained based on the rate of change in position angle θL obtained every second. As described above, the position detection unit 26 is made up of the sensor 38 and the position estimation unit 42*a*.

Position Detection Unit (Part 2)

The position detection unit 26 may include the rotation detector 36. In this case, correspondence information i1 is stored in the storage device 15*b* of the controller 15. The correspondence information i1 will be described. Even in a state where assisting force is not needed as described above, a weak force (tension) is applied to the belt member 13. In this state, when the user changes the position, the belt member 13 is wound up or let out. The rotation angle θM of the motor 33 as the operation amount of the actuator 14 at that time is detected by the rotation detector 36. There is a correlation between the position angle θL and the rotation angle θM of the motor 33 at the time when the belt member 13 is wound up or let out as a result of changing the position of the user. Then, as shown in FIG. 8, the correspondence information i1 that represents the relationship between the position angle θL and the rotation angle θM of the motor 33 at the time when the belt member 13 is wound up or let out as a result of changing the position of the user is stored in the storage device 15*b*.

Figure 8:
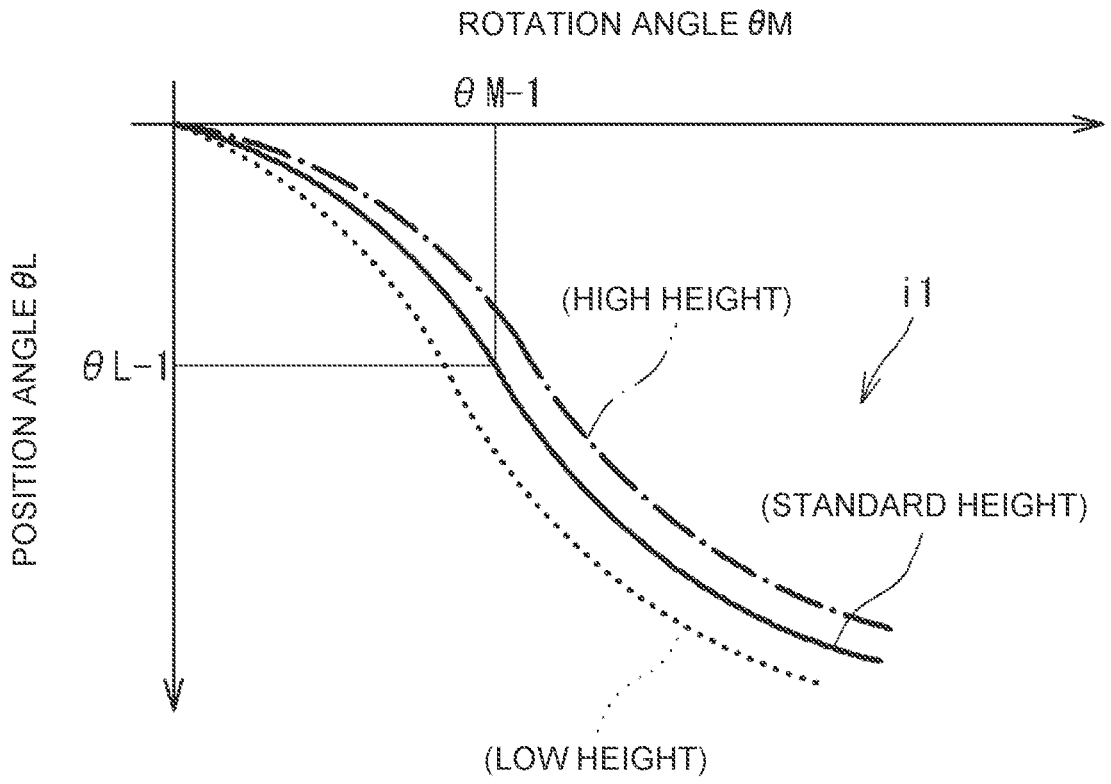
FIG. 8 is a graph showing correspondence information.

The correspondence information i1 may be not in the form of the graph as shown in FIG. 8 and may be a function between the rotation angle θM and the position angle θL or may be a table (database) in which the rotation angle θM and the position angle θL are associated with each other.

The continuous line shown in FIG. 8 represents correspondence information i1 in the case where the user has a standard height, the dotted line shown in FIG. 8 represents correspondence information i1 in the case where the height is lower than the standard height, and the alternate long and short dashed line shown in FIG. 8 represents correspondence information i1 in the case where the height is higher than the standard height. In this way, in the disclosure, the correspondence information i1 is information that is further set for each height of the user. The correspondence information i1 for each height may be a function obtained by converting a function representing correspondence information in the case of the standard height by using a coefficient or the like, other than the form of the graph or the form of the table.

The correspondence information i1 is information generated in advance. In other words, the correspondence information i1 is generated by causing users having various heights to wear the assist device 10, variously changing the position angle θL, and acquiring the rotation angle θM for each position angle θL.

As described above, the rotation detector 36 detects the rotation angle θM of the motor 33 at the time when the belt member 13 is wound up or let out as a result of changing the position of the user. When the rotation angle θM is detected, the position estimation unit 42*a* obtains the position angle θL based on the correspondence information i1. The position estimation unit 42*a* is capable of obtaining an angular velocity in a direction in which the position angle θL changes as a rate of change in the position of the user by finding the time derivative of the obtained position angle θL. Since the position angle θL is obtained every second, an angular velocity may be obtained based on the rate of change in position angle θL obtained every second. As described above, the position detection unit 26 includes the rotation detector 36 and the position estimation unit 42*a*.

Method of Obtaining Required Output

The required output of the actuator 14 in the direction to wind up the belt member 13 is obtained by the processing unit 42*b* of the controller 15. The processing unit 42*b* obtains the required output based on the position parameter (position angle θL) obtained by the position detection unit 26. Hereinafter, a specific example will be described.

To obtain a required output, conversion information i2 (see FIG. 9) representing the relationship between the position parameter (position angle θL) and the required output is used. The conversion information i2 is stored in the storage device 15*b* of the controller 15. The conversion information i2 is information generated in advance. In other words, the conversion information i2 is generated by setting in advance the required output of the actuator 14, estimated to be appropriate for each position angle θL, and associating the position angle θL with the required output corresponding to the position angle θL. The conversion information i2, as well as the correspondence information i1, may be in a graph form, a table form, or a function. In FIG. 9, for the sake of easy description, the conversion information i2 is in a table form. Pa, Pb, Pc, Pd respectively indicating required outputs in FIG. 9 each are a predetermined value. θL−1, θL−2, . . . , and the like indicating position angles each are also a predetermined value. A required output may be regarded as required assisting force from the actuator 14. The conversion information i2 may be acquired by another method or may be an arithmetic program having another algorithm.

When User Changes from Upright Position to Forward-Leaning Position

When the user changes the position, the position detection unit 26 obtains a position angle θL every second and obtains an angular velocity ω as a rate of change in position at the time from an upright position to a forward-leaning position. The angular velocity ω is a value in a direction in which the position angle θL changes. The position angle θL and the angular velocity ω may be values obtained by the position detection unit 26 (Part 1) with the sensor 38 or may be values obtained by the position detection unit 26 (Part 2) with the rotation detector 36.

When the position angle θL is obtained, a required output corresponding to the position angle θL is obtained based on the conversion information i2. When, for example, the position angle θL obtained by the position detection unit 26 is θL−30, the required output is Pc.

Then, when the angular velocity ω is obtained, a required output obtained from the conversion information i2 is corrected by using a coefficient for the angular velocity ω. The correction will be described. A coefficient F corresponding to an angular velocity ω is stored in the storage device 15*b* of the controller 15 as coefficient information i3 (see FIG. 10) set in advance. In FIG. 10, ω10, ω20, . . . , and the like indicating angular velocities ω each are a predetermined value. When, for example, the angular velocity at the time when the obtained position angle θL is θL−30 is ω30, the corresponding coefficient F is 0.7. Then, a coefficient of 0.7 in the case where the angular velocity is ω30 is applied to (multiplied by) a required output of Pc in the case where the position angle θL is θL−30. In other words, the required output of the actuator 14 in the case where the angular velocity is ω30 is 0.7×Pc.

In contrast, it is assumed that the angular velocity obtained at the time when the obtained position angle θL is θL−30 is ω10 lower than ω30. In this case, according to the coefficient information i3, the coefficient F corresponding to ω10 is 1.3. Then, a coefficient of 1.3 in the case where the angular velocity is ω10 is applied to a required output of Pc in the case where the position angle θL is θL−30. In other words, the required output of the actuator 14 in the case where the angular velocity is a low ω10 (lower than ω30) is 1.3×Pc.

When the user changes from an upright position to a forward-leaning position with a quick motion, it is desirable to reduce the output of the actuator 14 so as not to interfere with the position change. Then, when the position changes with a quick motion, that is, when the angular velocity obtained at the time of the position change is a relatively high ω30 as in the case of the example, the required output of the actuator 14 is 0.7×Pc and is a relatively low value.

In contrast, when, for example, the user changes from an upright position to a forward-leaning position with a slow motion as in the case where a person or a load is lifted down, it is desirable to increase the output of the actuator 14. Then, when the position changes with a slow motion, that is, when the angular velocity obtained at the time of the position change is a relatively low ω10 as in the case of the example, the required output of the actuator 14 is 1.3×Pc and is a relatively high value.

In this way, the processing unit 42*b* obtains a required output of the actuator 14 according to an angular velocity ω indicating a change in the position of the user. In other words, a required output of the actuator 14 is corrected by a coefficient F corresponding to an angular velocity ω and obtained. The required output of the actuator 14 is able to be varied between 0.7×Pc in the case where the user changes from an upright position to a forward-leaning position with a quick motion and 1.3×Pc in the case where the user changes the position with a slow motion.

However, when the output of the actuator 14 in the direction to wind up the belt member 13 is too low as a result of obtaining the required output according to the angular velocity ω, the belt member 13 loosens. In this case, after that, when assisting force is needed, it is not possible to generate appropriate assisting force. Then, in the disclosure, when a required output obtained according to an angular velocity ω is lower than a lower limit set value Qb, the processing unit 42*b* obtains the required output of the actuator 14 as the lower limit set value Qb or a value exceeding the lower limit set value Qb.

The lower limit set value Qb is set to, for example, the following value. As described above, when the assist device 10 worn on the user does not generate assisting force, the actuator 14 continues operating at a weak output in the direction to wind up the belt member 13. The weak output is an output weaker than that when assisting force is applied to the user. The lower limit set value Qb is set to a value corresponding to the weak output.

Figure 11:
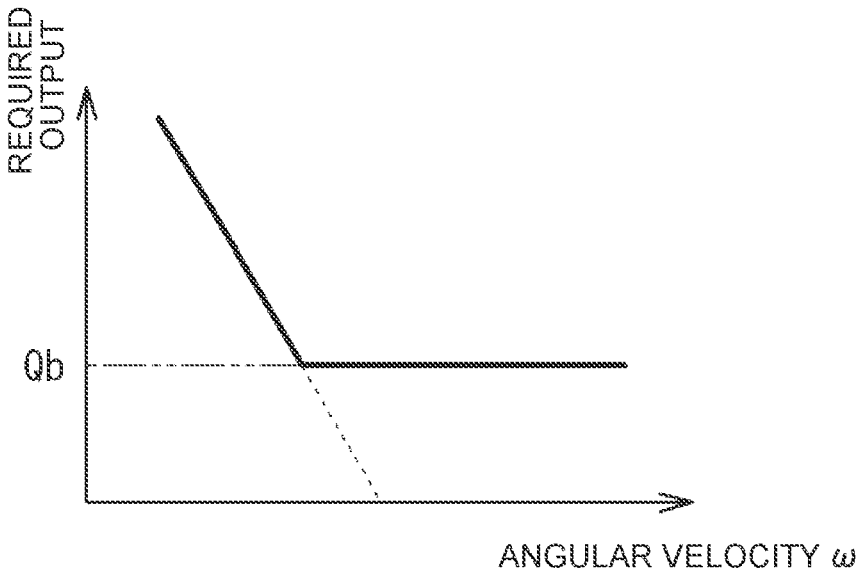
FIG. 11 is a graph showing a relation between an angular velocity of a change in the position of the user and a required output.

FIG. 11 is a graph showing a relationship between an angular velocity ω and a required output. In the coefficient information i3 (see FIG. 10), the coefficient F is set such that the required output reduces as the angular velocity ω increases. Therefore, as shown in FIG. 11, as the angular velocity ω increases, the required output reduces. However, when the required output is less than the lower limit set value Qb, the lower limit set value Qb is obtained as the required output. Alternatively, when the required output is less than the lower limit set value Qb, a value exceeding the lower limit set value Qb may be obtained as the required output.

When the required output is set in this way, it is possible to prevent slack in the belt member 13. FIG. 11 illustrates that the relationship between an angular velocity ω and a required output linearly varies (until the lower limit set value Qb); however, the relationship may nonlinearly vary or the relationship may vary in a stepwise manner.

When User Changes from Forward-Leaning Position to Upright Position

When the user changes the position, the position detection unit 26 obtains a position angle θL every second and obtains an angular velocity co as a rate of change in position at the time from a forward-leaning position to an upright position. The angular velocity ω is a value in a direction in which the position angle θL changes. The position angle θL and the angular velocity ω may be values obtained by the position detection unit 26 (Part 1) with the sensor 38 or may be values obtained by the position detection unit 26 (Part 2) with the rotation detector 36.

When the position angle θL is obtained, a required output corresponding to the position angle θL is obtained based on the conversion information i2 (see FIG. 9). When, for example, the position angle θL is θL−30, the required output is Pc. The conversion information i2 may be commonly used information between the case where the user changes from an upright position (the left side in FIG. 7) to the forward-leaning position (the right side in FIG. 7) and the case where the user changes in reverse from a forward-leaning position to an upright position, or may be different pieces of information between the former case and the latter case. In the disclosure, the conversion information i2 is commonly used information.

Then, when the angular velocity ω is obtained, a required output obtained from the conversion information i2 is corrected by using a coefficient for the angular velocity ω. The correction will be described. A coefficient F corresponding to an angular velocity ω is stored in the storage device 15*b* of the controller 15 as coefficient information i3 (see FIG. 10) set in advance. The coefficient information i3 may be commonly used information between the case where the user changes from an upright position (the left side in FIG. 7) to the forward-leaning position (the right side in FIG. 7) and the case where the user changes in reverse from a forward-leaning position to an upright position, or may be different pieces of information between the former case and the latter case. In the disclosure, the conversion information i2 is commonly used information.

When, for example, the angular velocity at the time when the position angle θL is obtained as θL−30 is ω30, the corresponding coefficient F is 0.7. Then, a coefficient of 0.7 in the case where the angular velocity is ω30 is applied to (multiplied by) a required output of Pc in the case where the position angle θL is θL−30. In other words, the required output of the actuator 14 in the case where the angular velocity is ω30 is 0.7×Pc.

In contrast, it is assumed that the angular velocity obtained at the time when the position angle θL is obtained as θL−30 is ω10 lower than ω30. In this case, according to the coefficient information i3, the coefficient F corresponding to ω10 is 1.3. Then, a coefficient of 1.3 in the case where the angular velocity is ω10 is applied to a required output of Pc in the case where the position angle θL is θL−30. In other words, the required output of the actuator 14 in the case where the angular velocity is a low ω10 (lower than ω30) is 1.3×Pc.

When the user changes from a forward-leaning position to an upright position with a quick motion, it is desirable to reduce the output of the actuator 14 so as not to interfere with the position change. Then, when the position changes with a quick motion, that is, when the angular velocity obtained at the time of the position change is a relatively high ω30 as in the case of the example, the required output of the actuator 14 is 0.7×Pc and is a relatively low value.

In contrast, when, for example, the user changes from a forward-leaning position to an upright position with a slow motion as in the case where a person or a load is lifted up, it is desirable to increase the output of the actuator 14. Then, when the position changes with a slow motion, that is, when the angular velocity obtained at the time of the position change is a relatively low ω10 as in the case of the example, the required output of the actuator 14 is 1.3×Pc and is a relatively high value.

In this way, the processing unit 42*b* obtains a required output of the actuator 14 according to an angular velocity ω indicating a change in the position of the user. In other words, a required output of the actuator 14 is corrected by a coefficient F corresponding to an angular velocity ω and obtained. The required output of the actuator 14 is able to be varied between 0.7×Pc in the case where the user changes from a forward-leaning position to an upright position with a quick motion and 1.3×Pc in the case where the user changes the position with a slow motion.

However, when the output of the actuator 14 in the direction to wind up the belt member 13 is too high as a result of obtaining the required output according to the angular velocity ω, excessive load acts on the actuator 14 (motor 33), so it is not desirable for the actuator 14 (motor 33). Then, in the disclosure, when a required output obtained according to an angular velocity ω exceeds the upper limit set value Qt, the processing unit 42*b* obtains the upper limit set value Qt or a value less than the upper limit set value Qt as the required output of the actuator 14.

Figure 12:
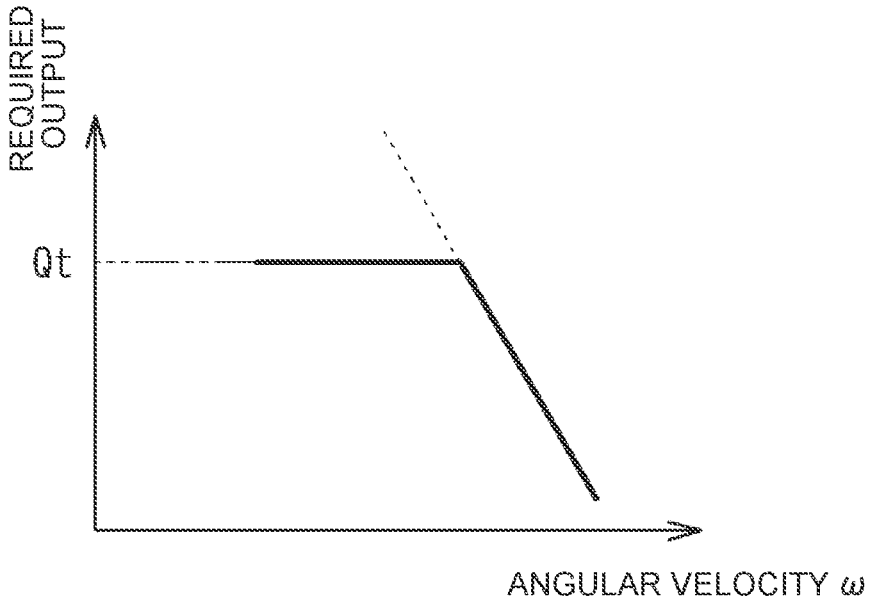
FIG. 12 is a graph showing a relation between an angular velocity of a change in the position of the user and a required output.

FIG. 12 is a graph showing a relationship between an angular velocity ω and a required output. In the coefficient information i3 (see FIG. 10), the coefficient F is set such that the required output increases as the angular velocity ω reduces. Therefore, as shown in FIG. 12, as the angular velocity ω increases, the required output decreases. However, when the required output exceeds the upper limit set value Qt, the upper limit set value Qt is obtained as the required output. Alternatively, when the required output exceeds the upper limit set value Qt, a value less than the upper limit set value Qt may be obtained as the required output. With this configuration, it is possible to prevent application of excessive load to the actuator 14 (motor 33). FIG. 12 illustrates that the relationship between an angular velocity ω and a required output linearly varies (until the upper limit set value Qt); however, the relationship may nonlinearly vary or the relationship may vary in a stepwise manner.

As described above, the required output of the actuator 14 in the direction to wind up the belt member 13 is obtained by the processing unit 42*b*. When the required output is obtained, a motor current corresponding to the required output is further obtained by the processing unit 42*b*. The motor current is applied to the motor 33 as a command signal. Thus, the actuator 14 operates at the required output. The relationship between a required output and a motor current may be, for example, set in advance, and information of the relationship may be stored in the storage device 15*b*. The processing unit 42*b* determines a motor current based on the information. A motor current corresponding to a required output may be obtained by another method.

The required output of the actuator 14 is a target value of assisting force to be generated by the actuator 14. The target value is a value corrected by a rate of change in position (angular velocity ω) (that is, a corrected target value), in addition, when the corrected value is less than a lower limit set value, another value (the lower limit set value or a value exceeding the lower limit set value) is obtained as a target value, or, when the corrected value exceeds an upper limit set value, another value (the upper limit set value or a value less than the upper limit set value) is further obtained as a target value.

Assist Device of Disclosure

As described above, the assist device 10 (see FIG. 2) of the disclosure includes the first worn component 11 worn on the shoulders BS of the user, the second worn components 12 respectively worn on the right and left legs BL of the user, the belt member 13, and the actuator 14. The belt member 13 is provided along the back surface side of the user over the first worn component 11 and the second worn components 12. The actuator 14 is provided on the first worn component 11 and is configured to be capable of winding up and letting out part of the belt member 13.

With the assist device 10, the belt member 13 is provided along the back surface side of the user over the first worn component 11 and the second worn components 12. When the actuator 14 winds up the belt member 13 (first belt 16), tension is applied to the first belt 16 and the second belt 17. With this tension, assisting force for helping the user at work is generated, so load on the body of the user is reduced.

When, for example, the user (helper) changes from a forward-leaning position to an upright position (see FIG. 7) while supporting a load (assisted person) with hands, the actuator 14 winds up the belt member 13 to apply tension to the belt member 13. With this tension, the user is easy to change from a forward-leaning position to an upright position, so load on the body of the user is reduced. In other words, tension that is applied to the belt member 13 by the actuator 14 is generated as assisting force.

The assist device 10 of the disclosure includes the position detection unit 26 that obtains a position angle θL as a position parameter indicating the position of the user. The controller 15 of the assist device 10 obtains the required output of the actuator 14 in the direction to wind up the belt member 13 based on the position angle θL, and controls the operation of the actuator 14. With this configuration, the actuator 14 does not operate at a constant output regardless of the position of the user, and the actuator 14 operates at an output for the position of the user (position angle θL). Therefore, the assist device 10 is capable of applying assisting force with an appropriate strength to a user according to the position of the user.

Another Assist Device

Figure 13:
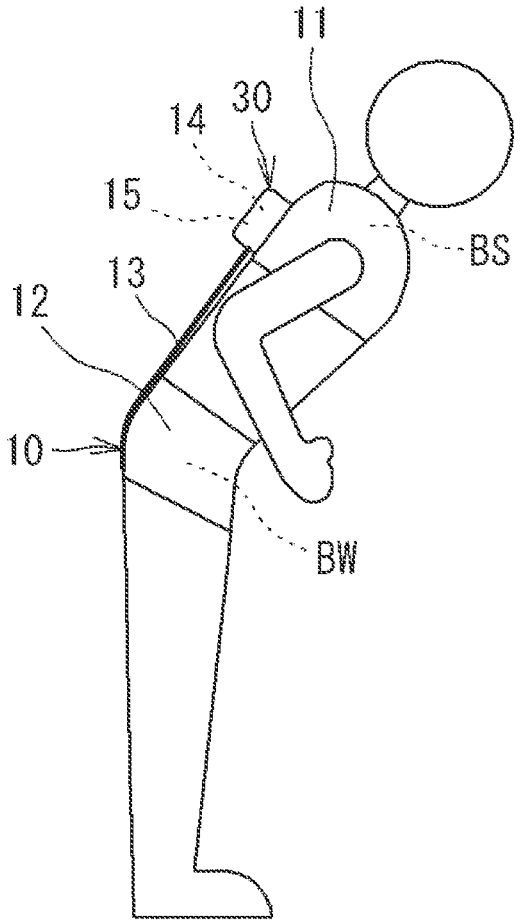
FIG. 13 is a side view showing an assist device of another embodiment.

In the assist device 10 of the disclosure, the second worn components 12 are respectively worn on the legs BL of the user. As shown in FIG. 13, the second worn component 12 may be worn on the hip BW of the user. In this case, the second worn component 12 may be a hip belt form or may be a pants form. When the second worn component 12 is worn on the hip BW, the actuator 14 may be mounted on the first worn component 11. Alternatively, the actuator 14 may be mounted on the second worn component 12. In this case, the sensor 38 for detecting the position of the user may be provided on the second worn component 12. In FIG. 13, the actuator 14 is mounted on the first worn component 11.

In the case of the assist device 10 shown in FIG. 13 as well, the belt member 13 is provided along the back surface side of the user over the first worn component 11 and the second worn component 12. When the actuator 14 winds up the belt member 13, tension is applied to the belt member 13. With this tension, assisting force for helping the user at work is generated, so load on the body of the user is reduced.

The embodiments described above are illustrative and not restrictive in all respects. The scope of the disclosure is not limited to the above-described embodiments. The scope of the disclosure encompasses all the modifications within the scope of the elements described in the appended claims and equivalents thereof

What is claimed is:

1. An assist device comprising:

a first worn component worn on at least one of a shoulder and a chest of a user;

a second worn component worn on one of a hip and a pair of right and left legs of the user;

a band-shaped belt member provided along a back side of the user that provides a variable tension force between the first worn component and the second worn component;

an actuator provided on one of the first worn component and the second worn component, the actuator being configured to wind up part of the belt member and configured to let out part of the band-shaped belt member, the actuator being configured to apply assisting force to the user by applying a force to the band-shaped belt member in a direction to wind up the belt member;

a position detection unit configured to obtain a position parameter indicating a position of the user; and a controller configured to obtain a required output in the direction to wind up the band-shaped belt member from the actuator based on the position parameter and configured to control operation of the actuator.

2. The assist device according to claim 1, wherein the controller is configured to cause the actuator to operate at a predetermined output in a standby state where the assisting force is not applied to the user, the predetermined output is an output in the direction to wind up the belt member and weaker than an output when the assisting force is applied to the user.

3. The assist device according to claim 1, wherein:

the position detection unit is configured to obtain a rate of change in position when the user changes from an upright position to a forward-leaning position; and the controller is configured to obtain the required output according to the rate of change.

4. The assist device according to claim 3, wherein the controller is configured to, when the required output obtained according to the rate of change is lower than a lower limit set value, obtain the lower limit set value or a value exceeding the lower limit set value as the required output of the actuator.

5. The assist device according to claim 1, wherein:

the position detection unit is configured to obtain a rate of change in position when the user changes from a forward-leaning position to an upright position; and the controller is configured to obtain the required output according to the rate of change.

6. The assist device according to claim 5, wherein the controller is configured to, when the required output obtained according to the rate of change is higher than an upper limit set value, obtain the upper limit set value or a value lower than the upper limit set value as the required output of the actuator.

7. The assist device according to claim 1, wherein the position detection unit includes a detector configured to detect an operation amount of the actuator when the belt member is wound up or let out as a result of a change in position of the user, and a position estimation unit configured to obtain the position parameter based on correspondence information representing a relation between the operation amount and the position parameter.

8. The assist device according to claim 1, wherein the position detection unit includes a sensor provided on one of the first worn component and the second worn component and configured to output a signal corresponding to a position of the user, and a position estimation unit configured to obtain the position parameter based on an output of the sensor.

* * * * *